US010689975B2

(12) United States Patent
Nyhavn et al.

(10) Patent No.: US 10,689,975 B2
(45) Date of Patent: Jun. 23, 2020

(54) PETROLEUM WELL TRACER RELEASE FLOW SHUNT CHAMBER

(71) Applicant: RESMAN AS, Trondheim (NO)

(72) Inventors: Fridtjof Nyhavn, Trondheim (NO); Christian Andresen, Vikhammer (NO); Gaute Oftedal, Trondheim (NO)

(73) Assignee: RESMAN AS, Trondheim (NO)

( * ) Notice: Subject to any disclaimer, the term of this patent is extended or adjusted under 35 U.S.C. 154(b) by 0 days.

(21) Appl. No.: 15/553,901

(22) PCT Filed: Feb. 27, 2015

(86) PCT No.: PCT/NO2015/050044
§ 371 (c)(1),
(2) Date: Aug. 25, 2017

(87) PCT Pub. No.: WO2016/137328
PCT Pub. Date: Sep. 1, 2016

(65) Prior Publication Data

US 2018/0038223 A1 Feb. 8, 2018

(51) Int. Cl.
*E21B 47/10* (2012.01)
*E21B 27/02* (2006.01)
(Continued)

(52) U.S. Cl.
CPC ..... *E21B 47/1015* (2013.01); *E21B 21/08* (2013.01); *E21B 27/00* (2013.01); *E21B 27/02* (2013.01)

(58) Field of Classification Search
CPC ..... E21B 47/1015; E21B 21/08; E21B 27/00; E21B 27/02
See application file for complete search history.

(56) References Cited

U.S. PATENT DOCUMENTS 6,840,316 B2 * 1/2005 Stegemeier ..... E21B 43/00 166/250.12
2011/0024111 A1 2/2011 Moen et al.
(Continued)

FOREIGN PATENT DOCUMENTS

EP 1 416 118 A1 5/2004
NO 20101684 A1 6/2012
(Continued)

OTHER PUBLICATIONS

International Preliminary Report on Patentability, issued in PCT/NO2015/050044, dated Apr. 18, 2017.
(Continued)

*Primary Examiner* — Silvana C Runyan
(74) *Attorney, Agent, or Firm* — Birch, Stewart, Kolasch & Birch, LLP

(57) ABSTRACT

A petroleum well tracer release flow shunt chamber in an annulus space about a base pipe and method of estimating one or more pressure differences or gradients, wherein the flow shunt chamber extending generally axial-parallel with the base pipe, and provided with a shunt flow passage for holding a shunt chamber fluid, and including: a tracer carrying system designed to release shots of tracer molecules or particles according to some control to the shunt chamber fluid, a first inlet aperture for receiving a first fluid, a second outlet aperture for releasing the shunt chamber fluid to a fluid, a flow restrictor nozzle unit allowing a pressure gradient between the inlet and outlet apertures driving the shunt chamber fluid out via the flow restrictor nozzle unit, topside recording the tracer transient response from the shunt chamber after tracer shots, extracting pressure gradients from recoded tracer transient response and tracer transient model, deriving wellbore inflow profile information from pressure gradients.

30 Claims, 13 Drawing Sheets

Figure 1:
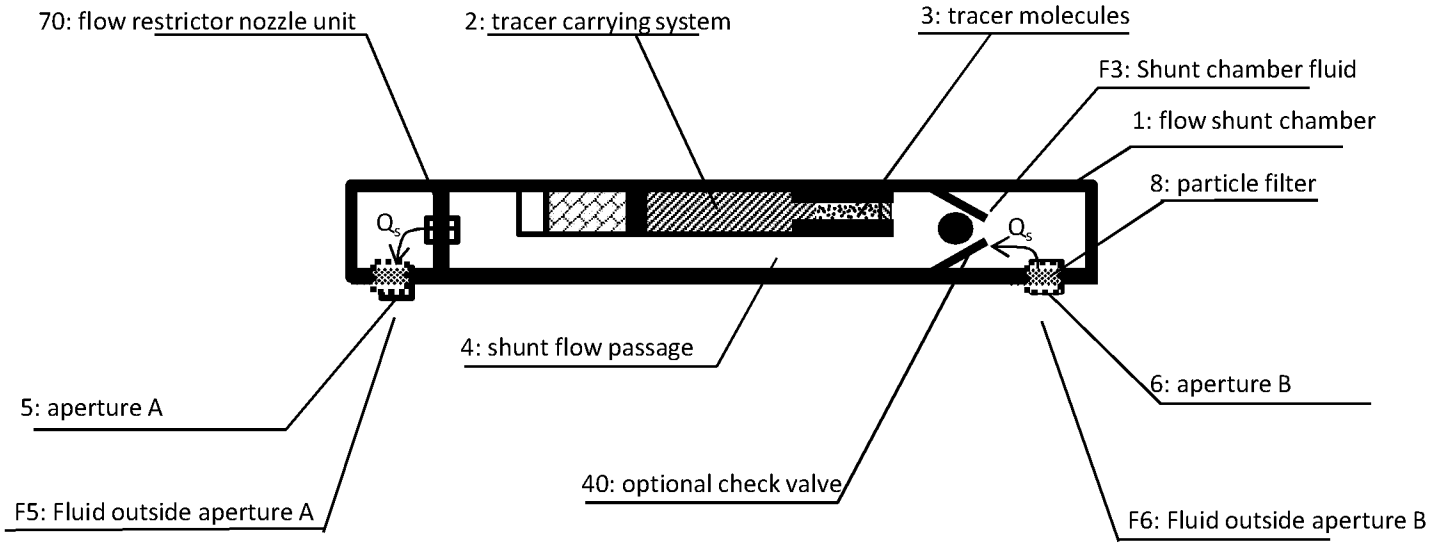

(51) Int. Cl.
*E21B 21/08* (2006.01)
*E21B 27/00* (2006.01)

(56) References Cited

U.S. PATENT DOCUMENTS

| | | | | |
|---|---|---|---|---|
| 2011/0257887 | A1* | 10/2011 | Cooper | E21B 47/1015 702/12 |
| 2013/0245948 | A1* | 9/2013 | Nyhavn | E21B 27/02 702/6 |
| 2016/0201454 | A1* | 7/2016 | Nyhavn | E21B 27/02 73/152.51 |

FOREIGN PATENT DOCUMENTS

| | | | |
|---|---|---|---|
| WO | WO 01/92685 | A1 | 12/2001 |
| WO | WO 2012/057634 | A1 | 5/2012 |
| WO | WO 2013/135861 | A2 | 9/2013 |
| WO | WO 2014/107113 | A1 | 7/2014 |
| WO | WO 2015/030596 | A1 | 3/2015 |

OTHER PUBLICATIONS

International Search Report, issued in PCT/NO2015/050044, dated Oct. 21, 2015.
Written Opinion of the international Searching Authority, issued in PCT/NO2015/050044, dated Oct. 21, 2015.

* cited by examiner

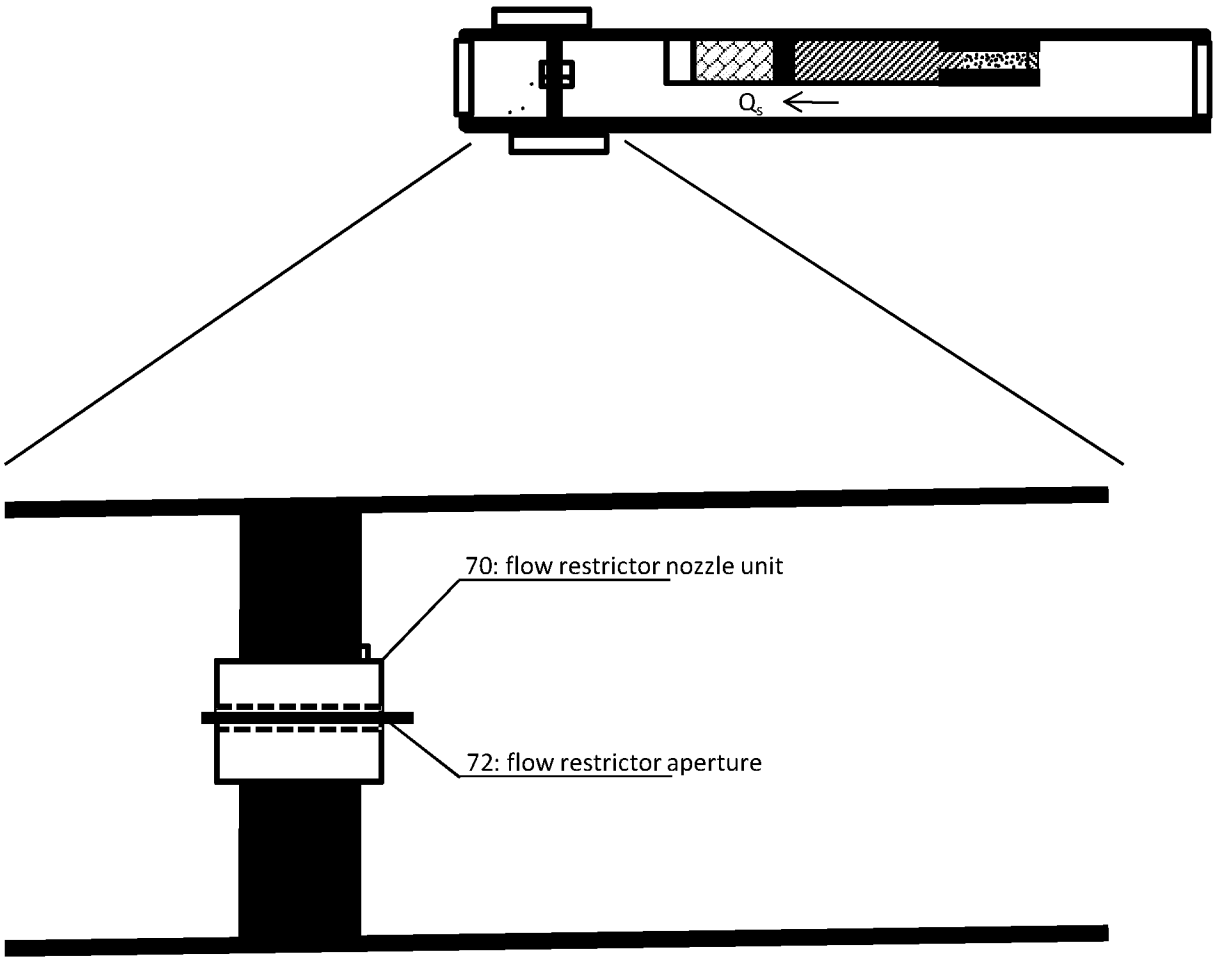
Figure 1c, interchangable nozzle, ref 1b

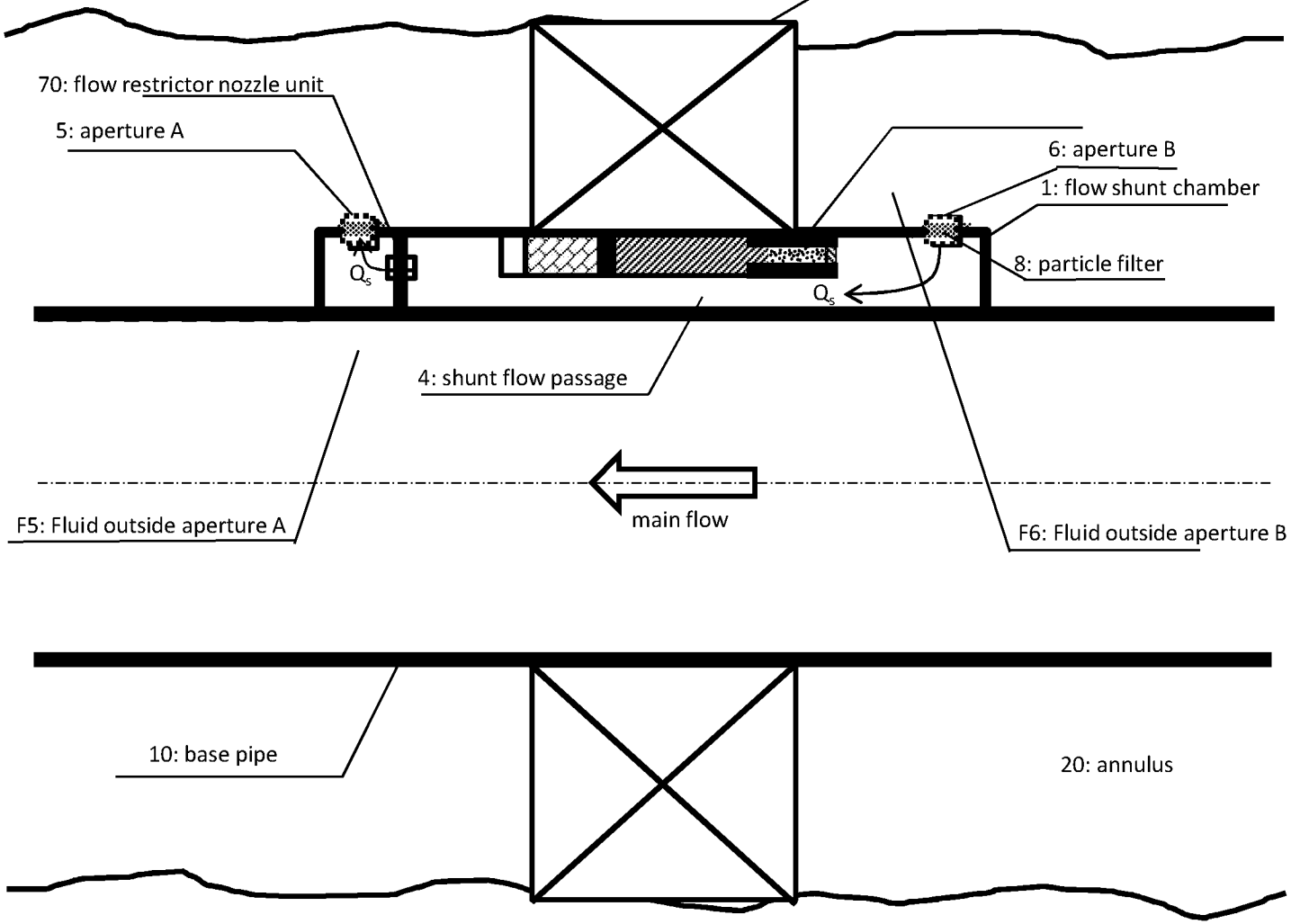
Figure 6, annulus isolation by packers

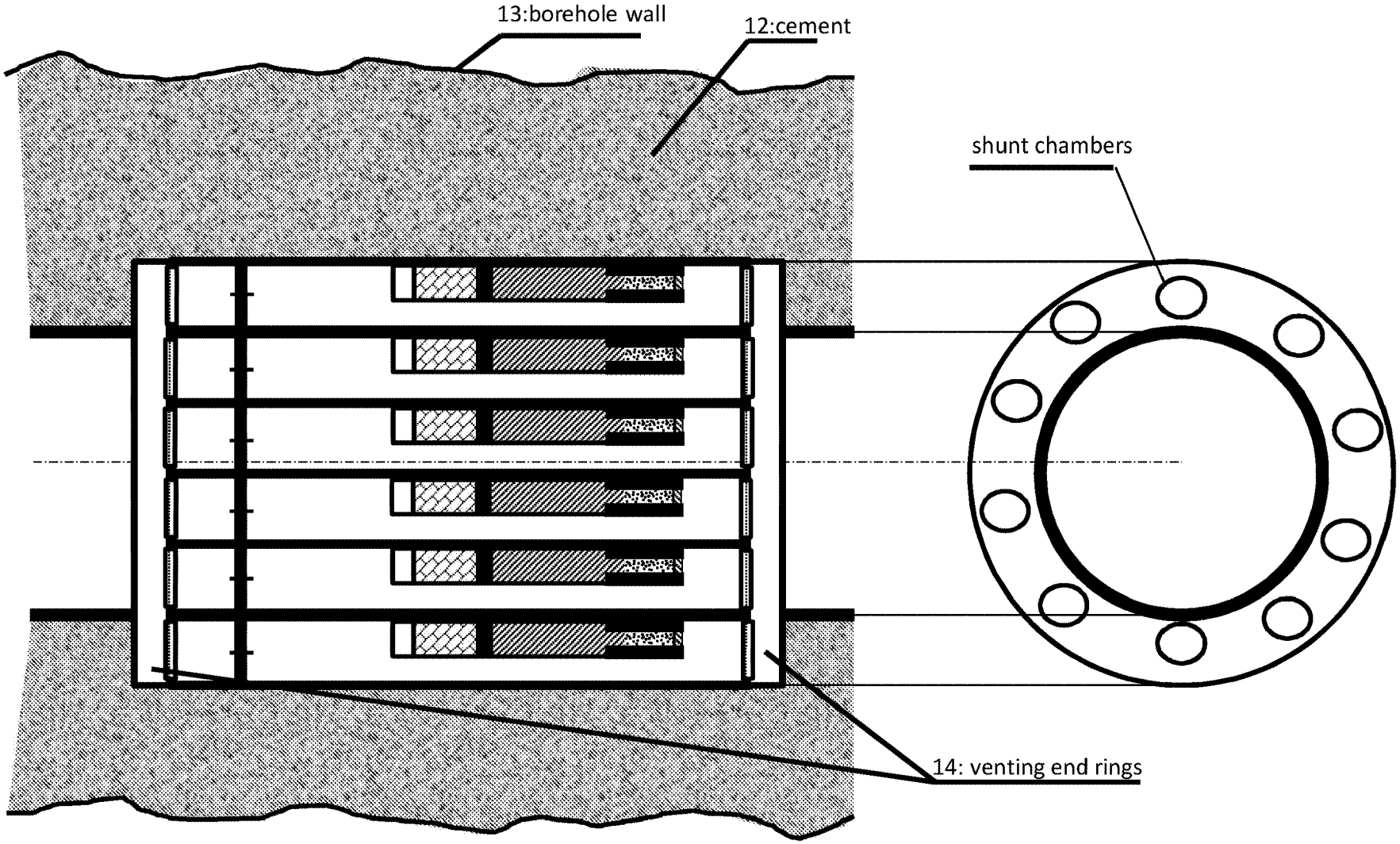
Figure 6a, annulus isolation by cement

Figure 7, example: two zone monitoring
(remember that the total flow at any place is the cumulative influx at every zone upstream (further down/in in the well))
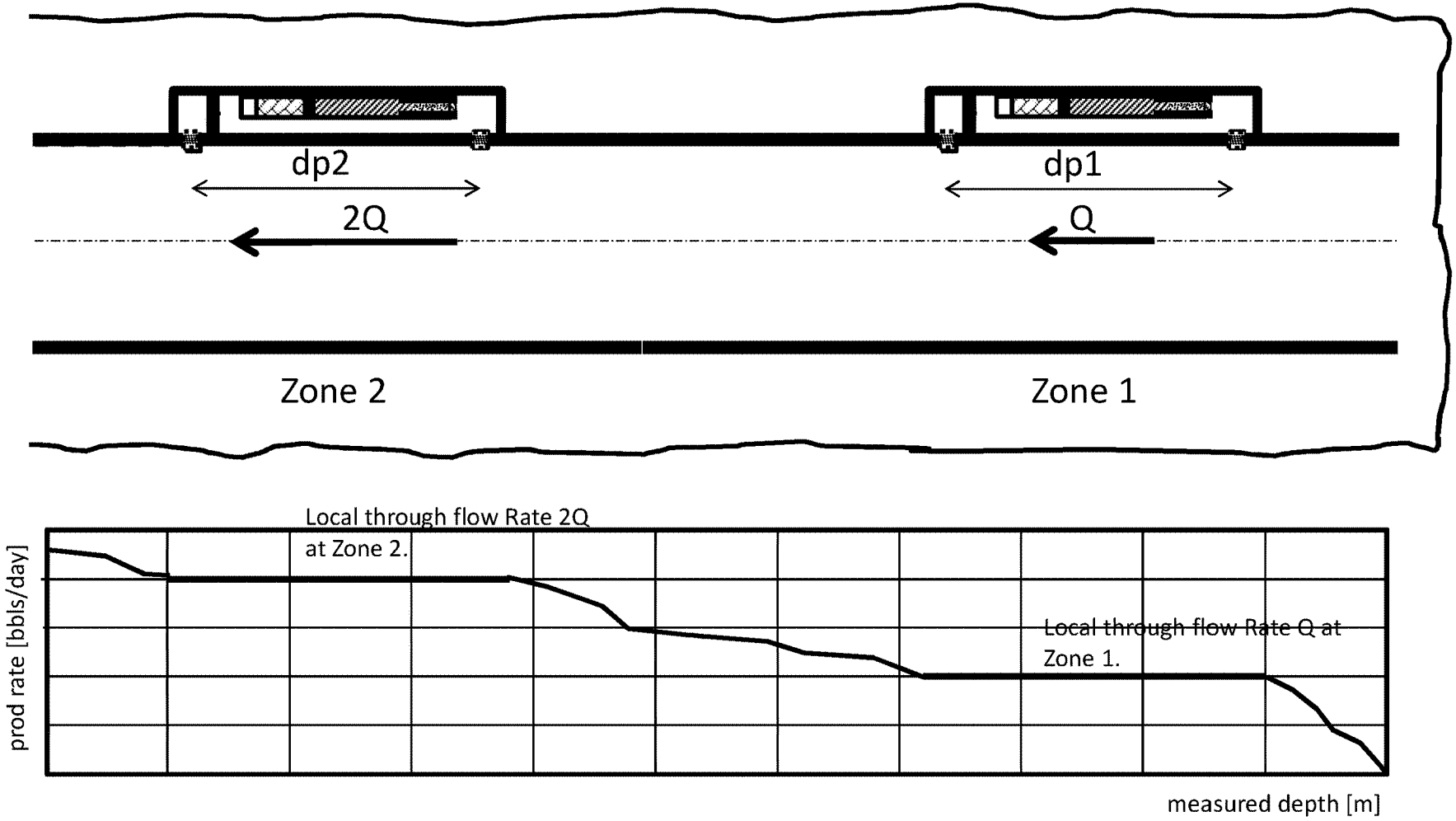

Figure 8, tracer transient from the Flow Shunt Chamber (1) with a shot during steady rate production, - a model example
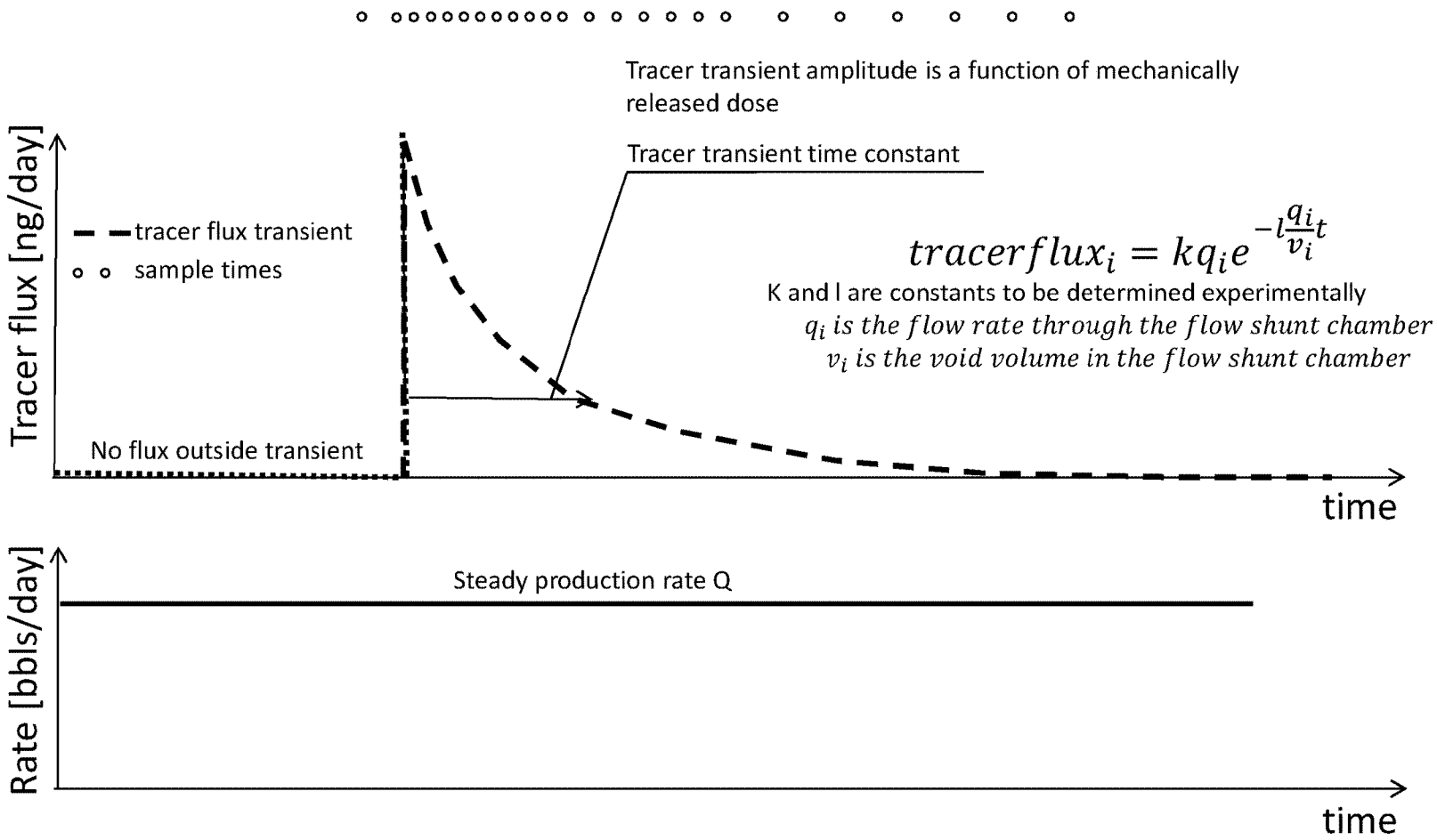

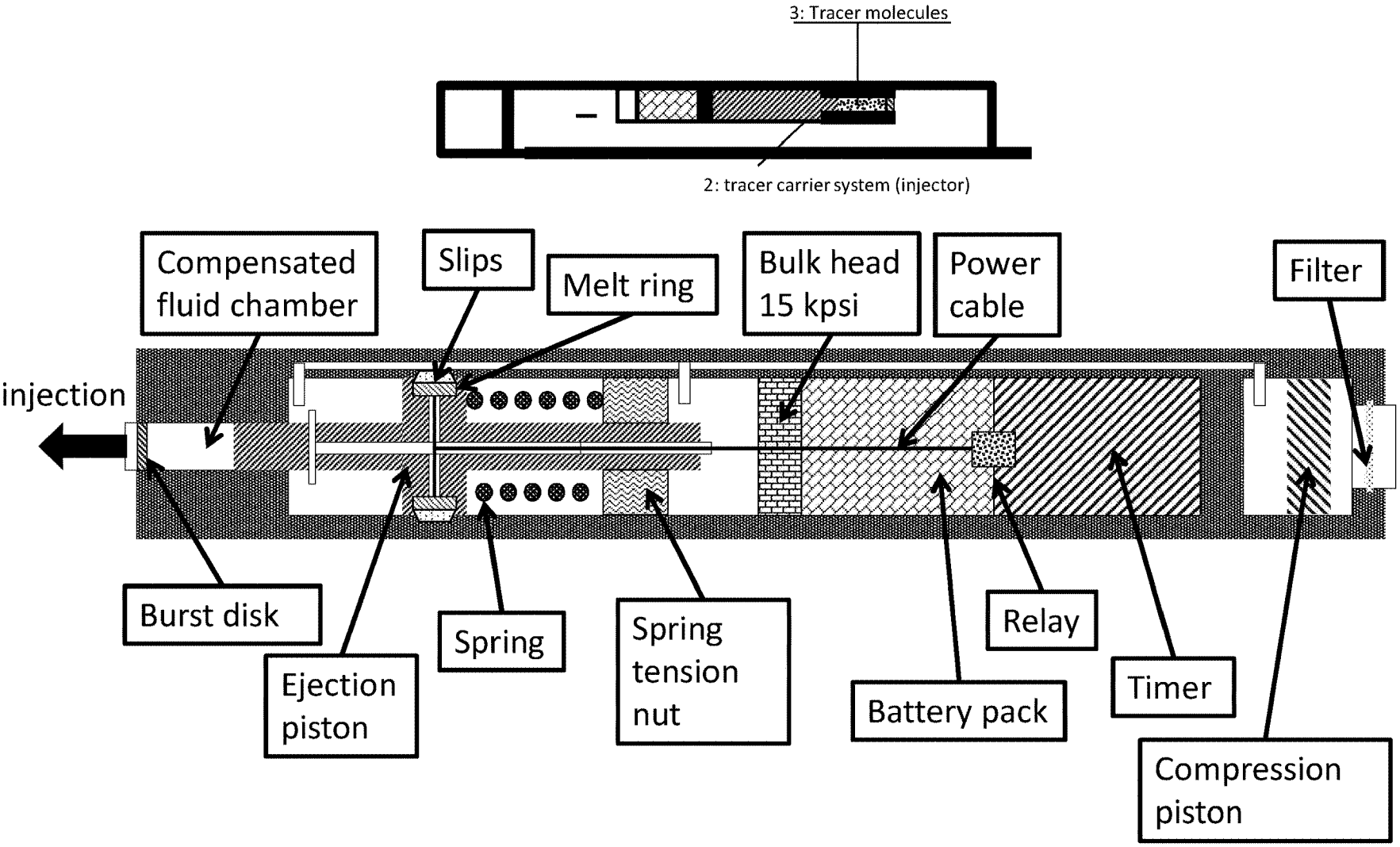
Figure 9, tracer carrier system (injector example)

PETROLEUM WELL TRACER RELEASE FLOW SHUNT CHAMBER

FIELD OF THE INVENTION

The invention is in the field of wellbore inflow profile monitoring during production. More specifically, the invention is used for indicating/estimating the so-called Wellbore Pressure Drawdown, i.e. a flow-induced wellbore pressure drop curve along the borehole. This pressure drawdown is primarily caused by the friction between the flowing fluids and the borehole wall. If the pressure drawdown is estimated and linked with drawdown/velocity (i.e. pressure gradient/velocity) models, the flow velocity field along the wellbore may be estimated or better understood. From this, the inflow profile may be extracted by simple mass flow consideration.

The invention is based on the exploitation of tracer transients during the flushing out of clouds of tracer molecules or particles that are placed with full mobility in flow shunts in the production zone by mechanical injectors. The tracer cloud flushout from the flow shunt is characterized by the pressure drop along the shunt, and if the cloud is not distorted on its way to surface, its shape may be read at surface. This is then the carrier of the basic information. The monitoring may be performed both at varying and steady production rates.

BACKGROUND ART

Permanent tracers installed in producer wells have by the applicant Resman and others been proven for estimating "what flows where and how much", i.e. which fluids flow in which parts of the well, and at which flow rates. Traditionally, different tracers have been placed in different influx zones to a production completion installed in a well. These tracers are normally initially immobilized, but they will release as a function of downhole properties like flow velocity, by the affinity to different fluids. Topsides sampling and analysis of the concentration curves over time of the different tracers is used to provide information on which fluids are flowing into which well zones, and may in some cases also indicate at which rates the influx occurs in those influx zones.

In the present context, a tracer carrying system (2) is an injector unit which releases tracer molecules or particles (3), such as a cylinder filled with a tracer carrying fluid and a piston that can drive out the molecules or particles (3) according to some control. By this method tracer clouds are mobile immediately after being injected and able to be transported with the fluids they are injected into. Such a tracer injection system for downhole use is described by many and U.S. Pat. No. 6,840,316 B2 is one such document where tracers are described as being injected into many different positions in well systems and where tracer concentrations are recorded somewhere downstream to enable the estimation of information related to inflow profiles. The injections are always done into parts of the main flow path of the well. What is new in this invention is that tracers are not injected directly into the main flow path of the well, but rather into flow shunts wherein the flow is a function of the main well flow and its pressure gradient. These flow shunts will have flow velocities that are different and normally lower compared to those in the main flow path. However, there should always be a deterministic relationship between the shunt flow and the main flow. Due to these facts, such shunt chambers are regularly referred to as Tracer Delay Chambers (TDC). TDCs are voids inside completions or volumes of gravel and formation where a cloud of tracer molecules or particles will have larger Residence Time Distribution (RTD) than in volumes in the main well flow path. The applicant has during 300 well installations accumulated knowledge from the usage of constantly releasing tracer carrying systems that points towards the fact that transient tracer responses from TDCs created during flow transients will represent the Residence Time Distribution (RTD) in the Tracer Delay Chambers (TDC) and therefore also the rate through it. The larger Residence Time Distribution (RTD) in the Tracer Delay Chambers (TDC) will lead to slower flush-outs of the tracers and thus longer tracer clouds travelling to surface. This is a benefit since smaller tracer clouds will more tend to be distorted by dispersion phenomena in the well hydraulics.

In this context, a base pipe is an established term for a central pipe in a production well, usually of steel, but which may be made in other materials. The Central pipe is an inner pipe into which the production fluid enters in the production zone, and which leads downstream all the way up/out to topside, although there may be some rearrangement of the piping at the wellhead.

BRIEF SUMMARY OF THE INVENTION

The invention is petroleum well tracer release flow shunt chamber (1) arranged in an annulus space (20) about a base pipe (10) in a petroleum well said flow shunt chamber (1) extending generally axial-parallel with said basepipe (10), said flow shunt chamber (1) provided with a shunt flow passage (4) for holding a shunt chamber fluid (F3), said flow shunt chamber (1) further comprising:

a tracer carrying system (2) in said shunt flow passage (4), said tracer carrying system (2) arranged for releasing unique tracer molecules or particles (3) according to some control to said shunt chamber fluid (F3), a first inlet aperture (6) to said flow shunt passage (4) for receiving a first fluid (F6) from outside said inlet aperture (6), a second outlet aperture (5) from said shunt flow passage (4) arranged downstream of said first inlet aperture (6) said second outlet aperture (5) for releasing said shunt chamber fluid (F3) to a fluid (F5) outside said second outlet aperture (5), a flow restrictor nozzle unit (70) arranged between said tracer carrying system (2) and said second outlet aperture (5), allowing a pressure gradient between said inlet and outlet apertures (6, 5) driving said shunt chamber fluid (F3) out via said flow restrictor nozzle unit (70).

flow restrictor nozzle unit (70) arranged somewhere between said et aperture (6) and said outlet aperture (5), allowing a pressure gradient between said inlet and outlet apertures (6, 5) driving said shunt chamber fluid (F3) out as a function of the flow area of said flow restrictor nozzle unit (70).

The invention is also the petroleum well tracer release flow shunt chamber (1) above, for being arranged in said annulus space (20) about said base pipe (10), having the defined properties above.

The invention in another aspect is a method of estimating one or more pressure differences or gradients along a producing petroleum well with a completion with a base pipe (10) in an annulus (20) and with one or more flow shunt chambers (1) according to claim 1 with unique tracer molecules or particles (3) and arranged along part or all of said base pipe (10), allowing well fluids to flow at a stable production flow rate, and injecting clouds of tracer molecules or particles in one or more flow shunt chambers (1), all while after some pre-estimated travel time to surface collecting a time-stamped series of fluid samples from said well fluids at a topsides sampling location, analyzing said series of fluid samples for concentrations $(c1_{sample}(t_i))$, $(c2_{sample}(t_i))$, . . . $(Cn_{sample}(t_i))$, calculating topsides tracer flux rate $(\rho_{topside})$ versus time curves from said concentrations $(ci_{sample}(t_i))$ and said flow rate for each tracer molecule (3) type, identifying the tracer flux transient associated with each flow shunt chamber (1), based on said tracer flux rate curves, calculating time constants $(t_{i1/2})$ for each tracer flux transient for each tracer molecule (3) type for said flow shunt chambers (1), based on said time constants $(t_{i1/2})$, estimating a pressure difference between said inlet aperture (6) and said outlet aperture (1) of each flow shunt chambers (1).

BRIEF FIGURE CAPTIONS

FIG. 1 illustrates an embodiment of the invention which is a shunt flow chamber (1) with an inlet aperture (6) to a shunt flow passage (4) which holds a tracer carrying system (2) which releases tracer molecules or particles (3) as fast and tracer-distributing injections to the shunt chamber fluid (F3) present within the flow passage (4), and with a flow restrictor nozzle unit (70) and an outlet aperture (5). After the injection, an evenly distributed mobile tracer cloud is formed in the flow shunt chamber (1) geometry. There is a filter (8) arranged at least at the inlet aperture (6) in order particularly to prevent clogging of particles of sand, organic matter, steel and cuttings which are ubiquitous in a petroleum fluid flow in a well. Advantageously there is also a filter (8A) arranged at the outlet aperture (5) in order to prevent clogging during installation or flushing or otherwise reverse temporary flow. The optional check valve (40) may be inserted to minimize the risk of reverse temporary flow. The fluid restriction property of the flow restrictor nozzle unit (70) preferably dominates over the other components' (6, 4, 5, 8, 8A) fluid restriction properties in order to feasibly control and calibrate the flow characteristics of the whole flow shunt chamber by just calibrating the fluid restrictor (7).

Figure 1A:
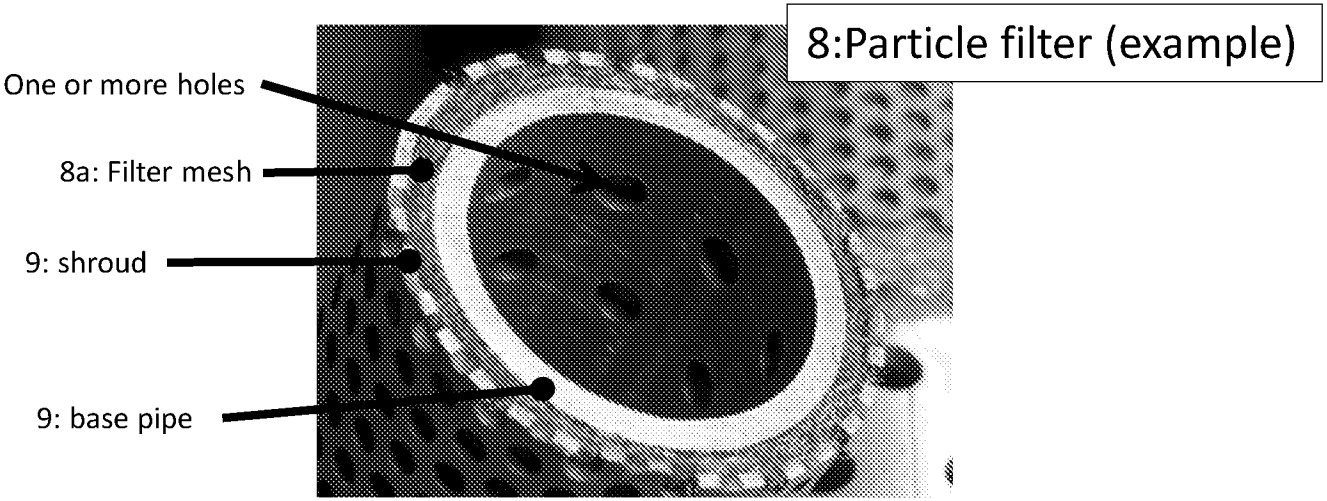

FIG. 1*a* illustrates a cross-section of an example of a particle filter (8). A filter mesh (8*a*) is installed between a base pipe (10) with inward positioned apertures (6) and a shroud (9) with outward positioned apertures to a surrounding position at the peripheral surface for installation of a shunt flow chamber (1) (not shown in FIG. 1*a*).

Figure 1B:
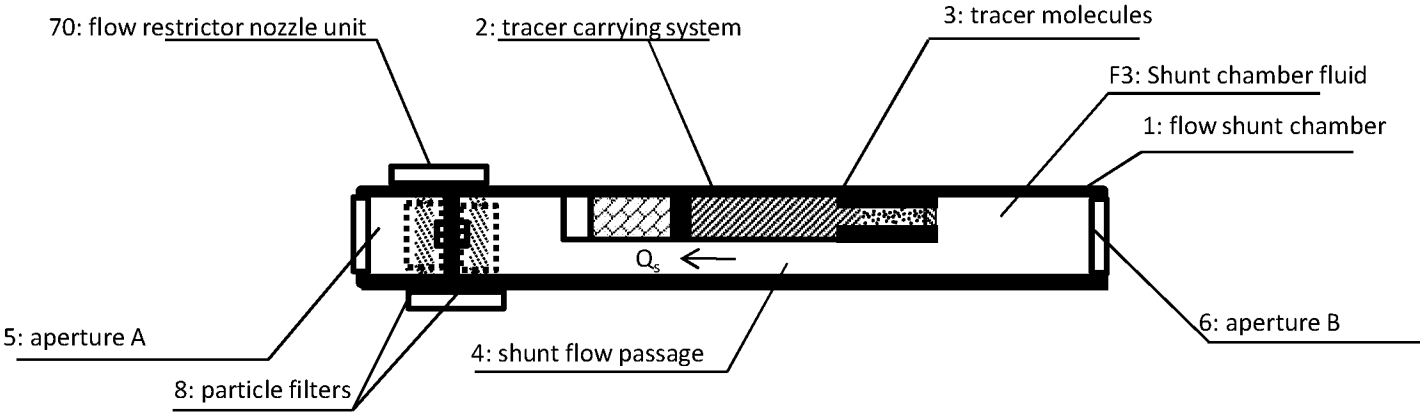

FIG. 1*b* shows a more general embodiment of the flow shunt chamber (1) with an inlet aperture (6). The inlet aperture is exposed to a fluid (F6) either in the base pipe (10) or in the annulus (20) or combinations of those (shown in FIGS. 2-6). From the inlet aperture (6) there is generally a shunt flow passage (4) with the tracer carrying system (2), e.g. a container with tracer molecules or particles (3) which can release the tracer as an injection shot into the shunt chamber fluid (F3), and with a particle filter (8) ahead of the flow restrictor nozzle unit (70) and another particle filter (8A) downstream of the flow restrictor nozzle unit (70), and an outlet aperture (5) to the surrounding fluid (F5), which may be in the base pipe or in the annulus.

FIG. 1*c* illustrates an embodiment of the flow restrictor, which may comprise an interchangeable flow restrictor nozzle unit (70) in the flow passage (4), the flow restrictor nozzle unit (70) provided with a flow restrictor aperture (72) of a given cross-section area.

Figure 2:
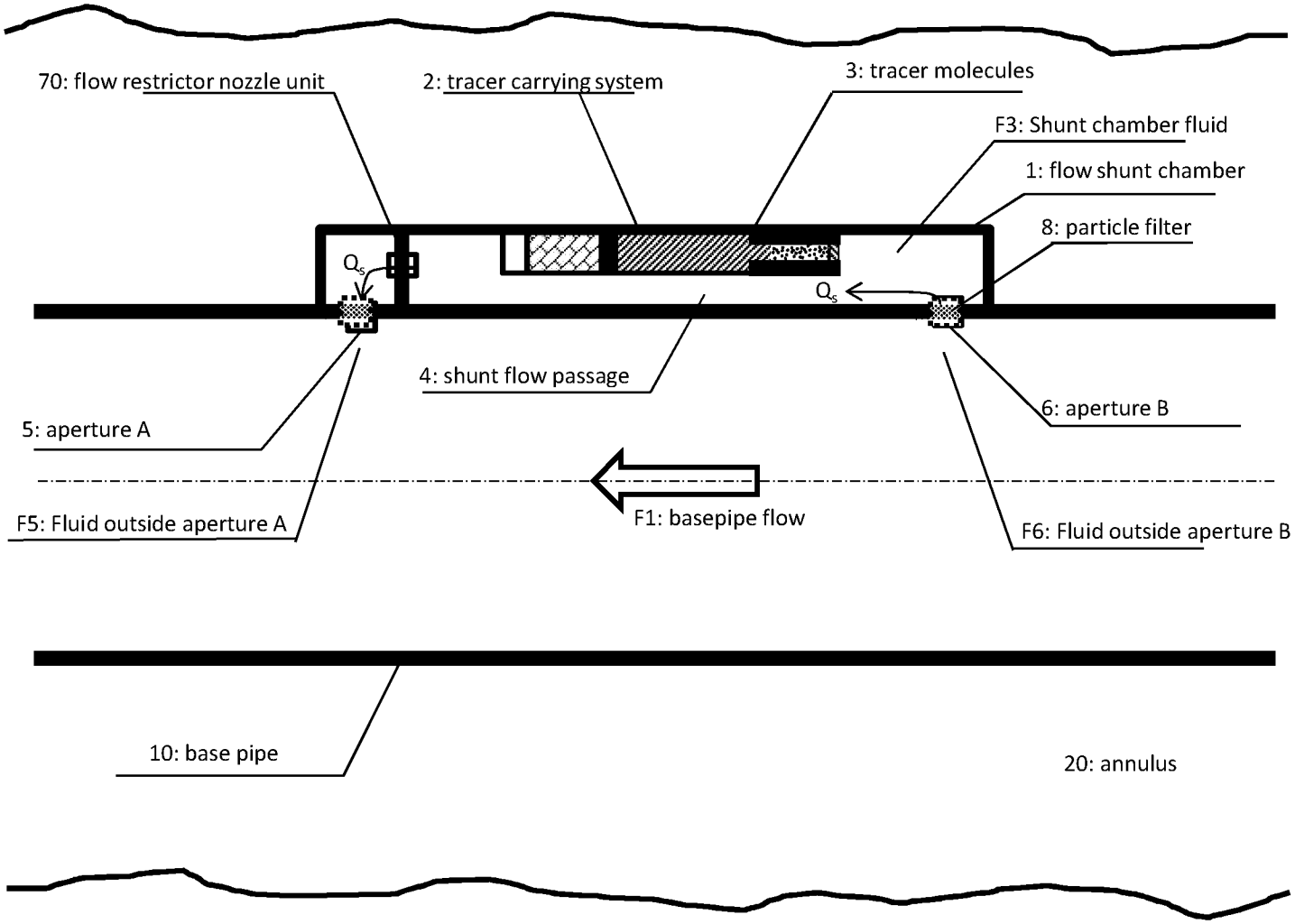

FIG. 2 is an illustration of how the flow shunt chamber (1) may be placed in a well. Here, the flow shunt chamber is arranged for estimating the pressure drop from aperture B (6) to aperture A (5) due to the base-pipe flow (F1). In this embodiment the flow shunt chamber (1) is arranged with influx aperture (6) and outlet aperture (5) both towards the base pipe (10) in a completion in an annulus (10) space (20) formed in a wellbore in a rock. Here the particle filter (8) is in the aperture (6), likewise a particle filter (8B) is arranged in the outlet aperture (5).

Figure 3:
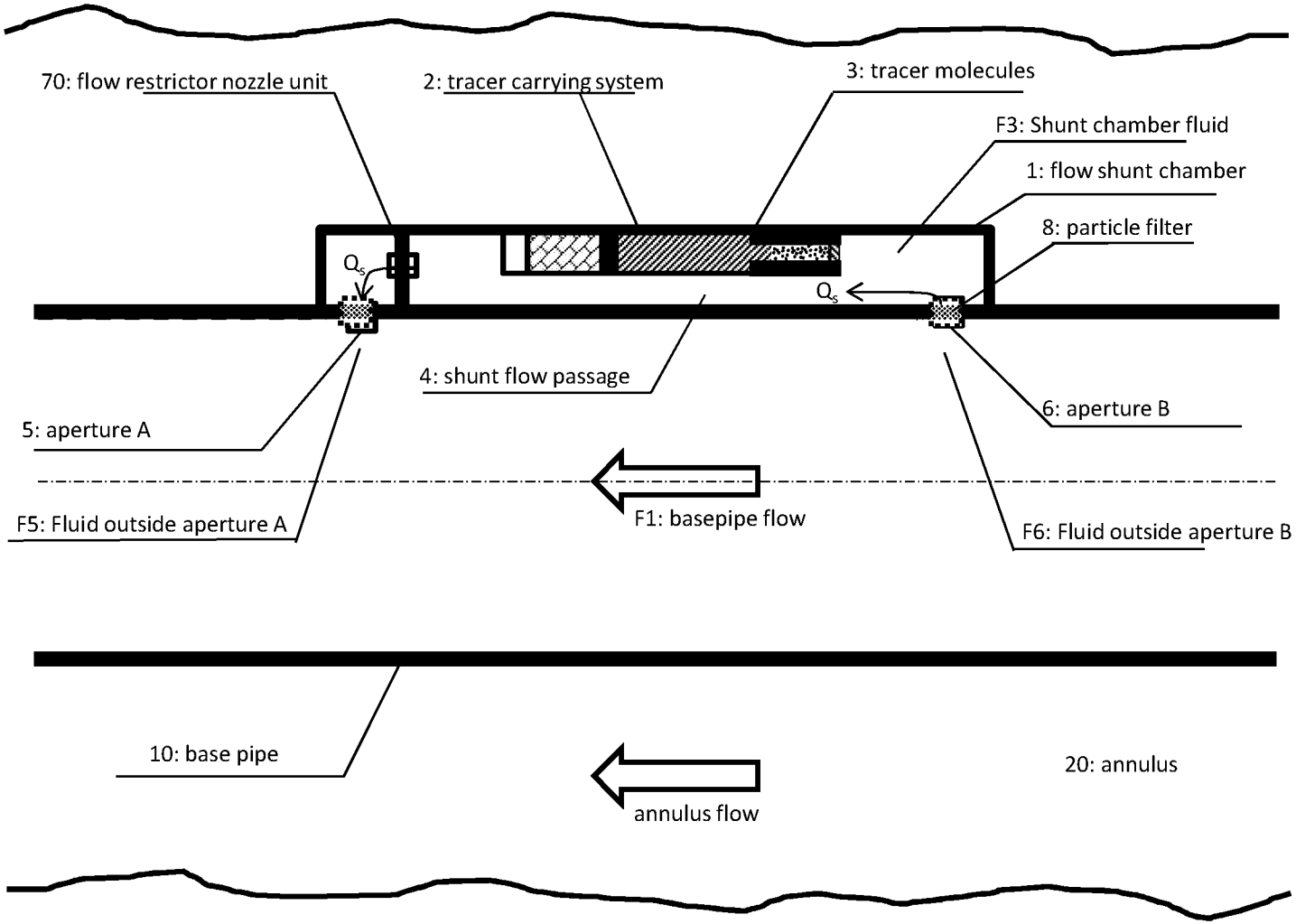

FIG. 3 is also a longitudinal section taken along the centre of a base pipe (10) as with FIG. 2. The only difference is that the base pipe comprises a fluid-permeable section to the right, a blank pipe with a flow shunt chamber of the invention and with the apertures (6, 5) from the blank pipe and a fluid-permeable section to the left. This embodiment will have no radial pressure gradient between the main flow in the base pipe (10) and the annulus (20) flow, so the flow shunt chamber will then monitor the pressure drop dues to the combined main+annulus flow. The pressure near aperture (6) will be equal in the base pipe (10), the aperture (6) and in the annulus (20) as we may assume little or no radial pressure gradient. The same observation applies around outlet aperture (5).

Figure 4:
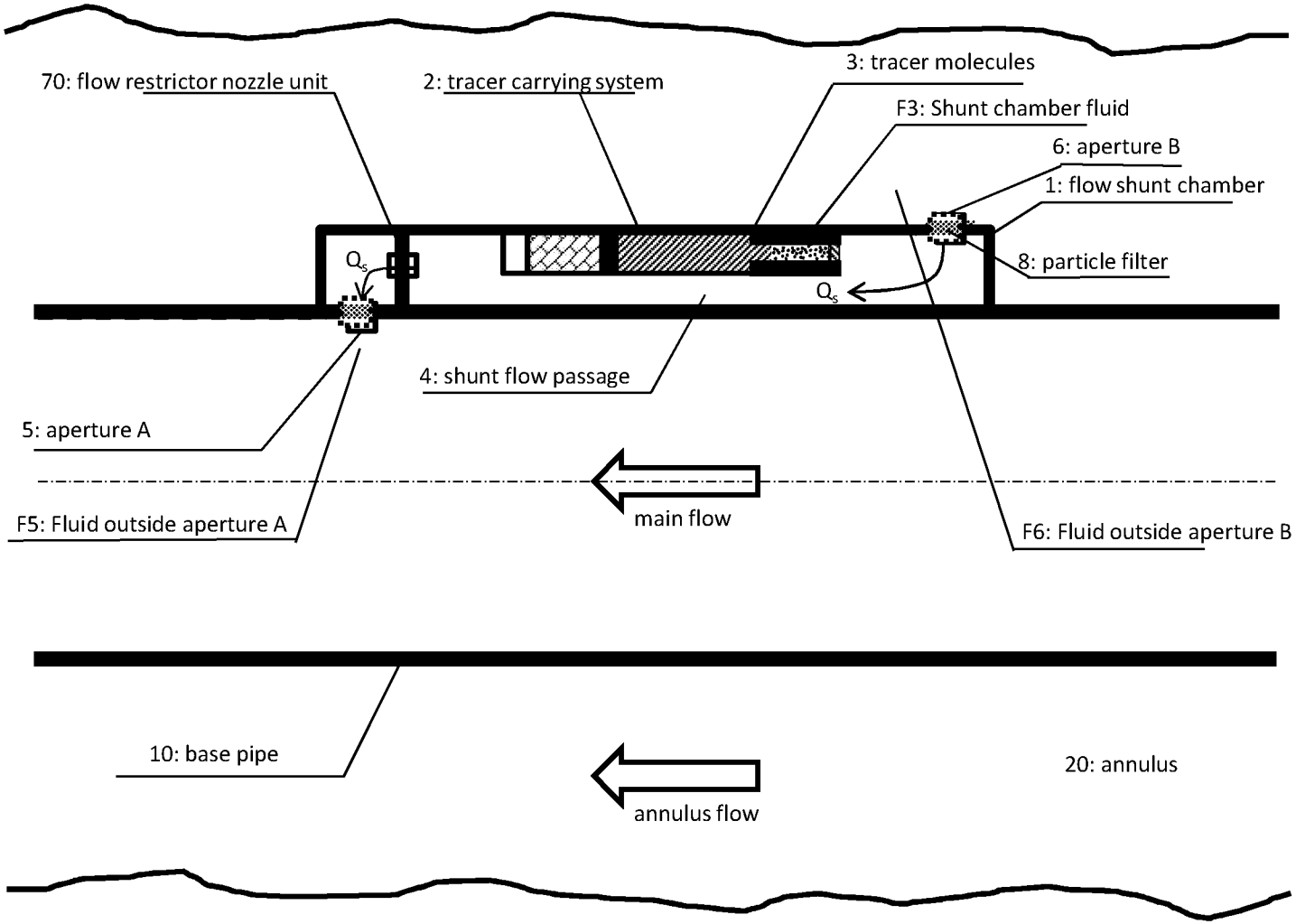

FIG. 4 shows an embodiment similar to the one of FIG. 3, with the difference that the inlet aperture (6) is facing towards the annulus (20). It is also possible to make a variant embodiment of the one of FIG. 4 wherein there is arranged inlet apertures (6) both facing the annulus (20) side and through the base pipe (10). Additionally, it is also possible to make an embodiment wherein there is outlet apertures (5) facing the annulus (20) and the base pipe (10). Either of those two embodiments may be arranged on a blank base pipe or on a pipe with apertures upstream and downstream of the flow shunt chamber (1) such as illustrated in FIG. 4.

Figure 5:
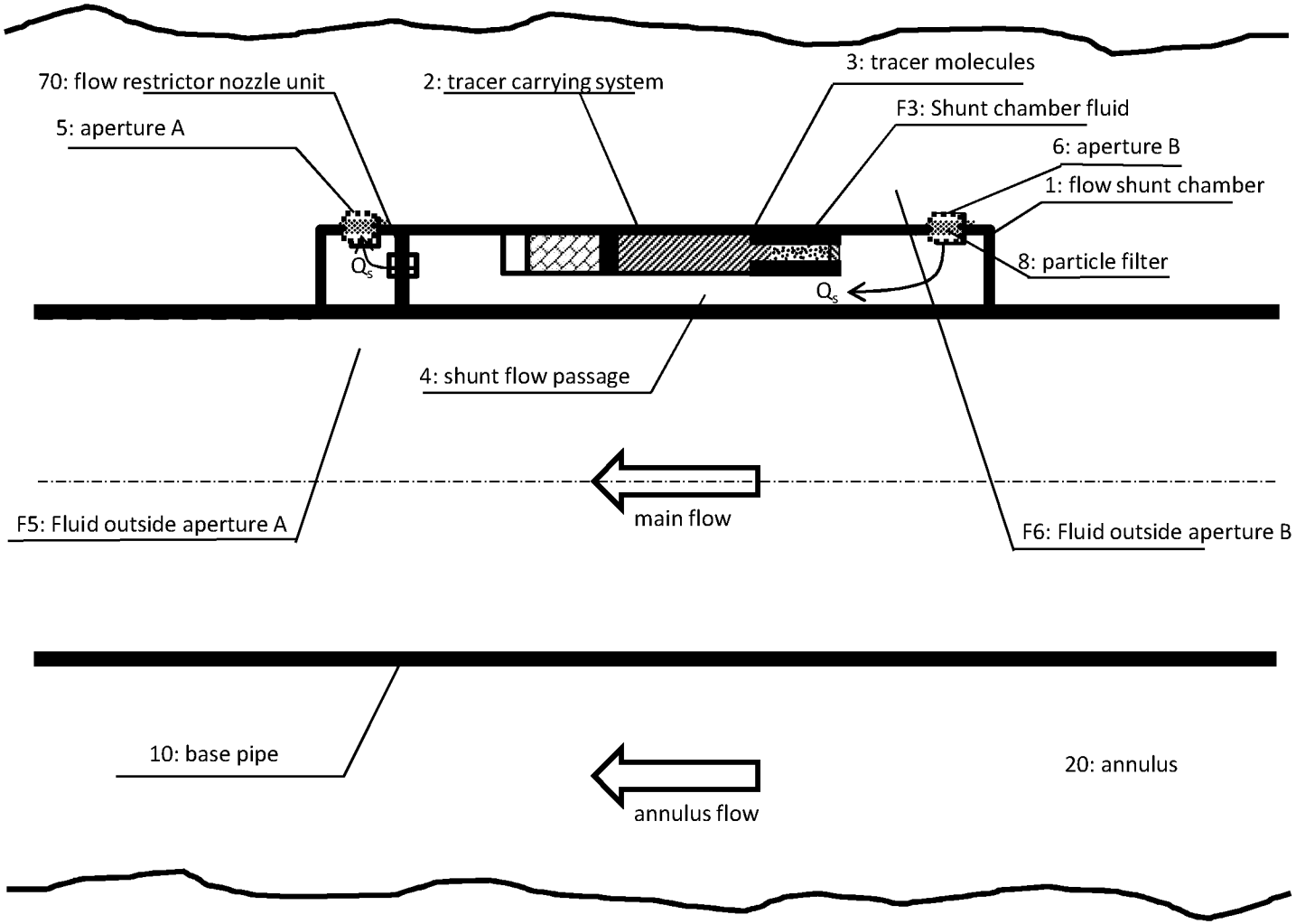

FIG. 5 illustrates a further development in the series from FIGS. 3 and 4, here with the outlet aperture (5) also facing the annulus space (20).

FIG. 6 illustrates an embodiment of the invention wherein a packer (11) is arranged about a blank basepipe (10) with a flow shunt chamber (1) according to the invention, with the inlet aperture (6) facing the annulus (20). Thus the outside fluid (F6) is in the annulus. Likewise, the outlet aperture (5) faces the annulus (20) downstream of the packer, so the outside fluid (F5) is in the annulus, too. The pressure across the packer will thus drive a very small flow through the shunt flow passage (4), and if the outside fluid (F5) is subsequently led to the main flow (F1) through an aperture in the base pipe (10) downstream of the present packer-isolated annulus flow shunt chamber (1) the pressure across the packer (11) may be estimated. A variant embodiment with a screen upstream and downstream of the flow shunt chamber would be possible but may render the packer less useful.

FIG. 6*a* illustrates in a longitudinal combined view of a cross-section of a base pipe (10) surrounded by cement (14) in the annulus (20) and a borehole wall (13), and in an open, elevation view of shunt flow chambers (1) of the invention enveloping the base pipe (10). A venting end ring (14) is arranged at either ends of the shunt flow chambers (1) so as for forming inlet apertures (6) and outlet apertures (5) for allowing fluid communication between the base pipe (10) and the flow passages (4). An advantage of this embodiment of the invention is that an axial-parallel array of perforation guns may be used to perforate the basepipe (10) without the risk of destroying more than one of the flow shunt chambers (1), and without destroying the venting end ring aperture (14).

FIG. 7

Upper: This is a longitudinal section with a highly simplified illustration through a part of a producing well, this particular example showing the toe end of a producing well. Petroleum fluids seep in through the borehole wall from the surrounding reservoir rocks to the annulus space (20) and enter through perforated sections in the base pipe (10). We simply assume that the fluids are petroleum.

The lower graph is an imagined production rate versus depth (NB: not vs. time) in the above base pipe. One may have a completion with several more flow shunt chambers (1) arranged along in this manner along a base pipe (10) in a completion from toe to heel in a producing well.

FIG. 8 shows the tracer flux from one flow shunt chamber after an injection.

The big issue is to extract transient time constant information from curves like the one in FIG. 8, and from those the differential pressures over all flow shunt chambers. Voila, we do have points on the curve for production rate versus measured depth as seen on the lower graph of FIG. 7.

FIG. 9 is a design drawing of an embodiment of the tracer carrying system (2). It is releasing shots of tracer molecules or particles and is a traditional syringe design with pressure compensation for different well pressures.

EMBODIMENTS OF THE INVENTION

With the present invention it is realized that that much can be gained by improving the design of such delay chambers and also by the usage of such delay chambers and the methods for utilizing such delay chambers and on interpreting tracer measurements resulting thereof. The inventor's objective is that the tracer carrier may be used so that flow information through the modulator device (=the delay chamber) is modulating the tracer flux from the delay chamber. Modulations will be tracer transients so that the information can be read after being migrated through the downstream upper completions and tiebacks of short or long distance to a fluid sampling site.

Overall Purpose of the Invention

The overall purpose of the invention is to estimate the pressure difference between inlet and outlet apertures (6 and 5), and thus provide some pressure gradients along the production zone, in order to estimate a pressure profile between a "toe" and a "heel" in a production zone by integrating the pressure gradient profile.

The invention illustrated in FIGS. 1 to 6*a* is in general petroleum well tracer release flow shunt chamber (1), comprising a tracer carrying system (2) arranged for releasing tracer molecules or particles (3) to a shunt chamber fluid (F3) at any time present in said chamber (1), said tracer carrying system (2) placed in said tracer release chamber (1) between a first, inlet aperture (5) and a second, outlet aperture (6) connecting said shunt chamber hydraulically with fluids (F5) and (F6) outside the flow shunt chamber, with a flow restrictor nozzle unit (70) inserted into the shunt flow passage (4) between said first, inlet aperture (5) and said second, outlet aperture (6) to create a controlled overall flow restriction to the shunt flow (Qs), so as to establish a flow (Qs) through the shunt chamber being driven by any pressure difference between the two apertures (5) and (6).

In an embodiment of the invention particle filters (8, 8B) are preferably inserted in one or both of outlet and inlet apertures (5) and (6) to reduce the risk of plugging the flow restrictor nozzle unit (70). Particularly it is important to have particle filter (8) installed in inlet aperture (6). The particle filter (8) may be installed just ahead of flow restrictor nozzle unit (70) in an embodiment of the invention.

Arrangement in the Completion in the Well

The flow shunt chamber (1) is arranged for extending generally axial-parallel with said basepipe (10). This is also parallel with and a desired basepipe flow (F1) if established, or at least with a desired annulus space (20) flow. The fluid (F5) is in the base pipe (10) or annulus space (20) and is transported directly or indirectly downstream for eventually being sampled and analyzed for tracer molecules or particles (3). The fluid (F6) is in the base pipe (10) or in the annulus space (20). One must have control over the total fluid flow out of the well at any time, and the concentration of tracer molecules or particles (3) in samples taken at a topsides sampling site. The term "base pipe" (10) used here is to be understood as the inner pipe in the production zone, also called the "central pipe" into which the production fluid flows and through which the production fluid flows downstream, usually at least to the wellhead or further topsides past the wellhead, such as to a production platform.

The invention illustrated in FIG. 1, 1*a-c*, 2, 3, 4, 5, and 6 is a petroleum well tracer release flow shunt chamber (1) for being arranged in an annulus space (20) about a base pipe (10), i.e. a central pipe (10) in a petroleum well. The flow shunt chamber (1) extending generally axial-parallel with said basepipe (10). The flow shunt chamber (1) is provided with a shunt flow passage (4) for holding a shunt chamber fluid (F3) which generally is the fluid present and flowing slowly through the device of the invention. The flow shunt chamber (1) comprises the following main features:

a tracer carrying system (2) in the shunt flow passage (4), the tracer carrying system (2) designed for releasing shots of unique tracer molecules or particles (3) at controlled times to said shunt chamber fluid (F3). The reason for using unique tracer molecules or particles is due to the fact that one may then simultaneously monitor tracer flux from several different flow shunt chambers arranged along the completion in a well.

a first inlet aperture (6) to said flow shunt passage (4) is arranged for receiving a first fluid (F6) from outside said inlet aperture (6), i.e. upstream fluid from the base pipe, from the annulus space, or both.

a second outlet aperture (5) from said shunt flow passage (4) arranged downstream of said first inlet aperture (6) said second outlet aperture (5) for releasing said shunt chamber fluid (F3) to a fluid (F5) outside said second outlet aperture (5), which also may be to the base pipe, the annulus space, or both.

a flow restrictor nozzle unit (70) arranged between said tracer carrying system (2) and said second outlet aperture (6), allowing a pressure gradient between said inlet and outlet apertures (6, 5) driving said shunt chamber fluid (F3) out via said flow restrictor nozzle unit (70). The flow restrictor nozzle unit (70) may be a selectable plug with a pinhole or a plug with a screw adjustable hole, which may be arranged in the workshop during assembly of the flow shunt chamber or during calibration of the flow shunt chamber.

The petroleum well tracer release flow shunt chamber (1) of claim 1, said tracer carrying system (2) designed for releasing shots of unique tracer molecules or particles (3) at controlled times into said surrounding shunt chamber fluid (F3).

Particle Filters

In an embodiment of the invention illustrated The petroleum well tracer release flow shunt chamber (1) of any of the preceding claims, said flow shunt chamber (1) provided with a first particle filter (8) in said flow shunt passage (4) between inlet aperture and said flow restrictor nozzle unit (70). In an embodiment of the petroleum well tracer release flow shunt chamber (1) of the invention, the inlet aperture (6) is provided with said first particle filter (8). The petroleum well tracer release flow shunt chamber (1) may also be provided with a second particle filter (8A) between said flow restrictor nozzle unit (70) in said flow shunt passage (4) and said second, outlet aperture (5). The second outlet aperture (5) may also be provided with said second particle filter (8A).

In general, said first inlet aperture (6) is directly fluid communicating via said shunt flow passage (4) and said flow restrictor nozzle unit (70) to said second outlet aperture (5). The flow shunt chamber may in an embodiment be provided with a check valve (40) to allow fluids to flow through the shunt chamber in one direction only; from the inlet aperture (6) end towards the outlet aperture end (5).

Mounting

In the illustrated and preferred embodiment of the invention said flow shunt chamber (1) is placed in said annulus (20) formed outside of said base pipe (10) in said petroleum well. The illustrations show a shunt chamber (1) mounted at the outer wall of the base pipe, with appropriate apertures towards the base pipe, the annulus, or both. A barrel-like array such as the one in FIG. 6*b* is also envisaged, cemented in the annulus or not. Placement of the flow shunt chamber at the inner wall is possible, but may be undesirable because it would present possible obstacles to logging tools, valve tools, intervention tools, and to the base pipe flow itself. Such a variety of the present invention is thus not significantly different from the embodiments illustrated.

Various Inlet and Outlet Directions

In an embodiment of the invention illustrated in FIGS. 2 and 3, said apertures (5) and (6) are hydraulically connected to the fluids in said base pipe (10) so that the shunt flow Qs is a function of the pressure distribution along the base pipe's (10) interior, the base pipe (10) being either a blank pipe section (FIG. 2) or a perforated section (FIG. 3) or a combination of the two. This will enable the user to measuring pressure drop between said apertures A and B in said base pipe.

In an embodiment illustrated in FIG. 6*a* the tracer release flow shunt chamber of the invention is embodied as a number of such shunt chambers (1) mounted in a barrel-like array around the circumference of the base pipe (10) and sealingly cemented by cement (14) to the borehole wall (13). The inlet apertures (6) are mutually connected by a first venting end ring (14) open inwardly to said base pipe (10), the outlet apertures (5) are also mutually connected by a second venting end ring (14) open inwardly to said base pipe (10), the shunt chambers (1) are fully isolated from each other between said end rings (14) by partition walls (18). Thus the barrel array is arranged for a line of perforations to be shot by a linear gun array so that one or two of the shunt chambers (3) are directly hydraulically connected to the surrounding fluids, all other shunt chambers (3) are intact and will continue to operate.

In and embodiment of the invention said outlet aperture (5) is arranged downstream of said inlet aperture (6) and one or more of said apertures (5, 6) are apertures through a pipe wall (21) of said base pipe (10).

In and embodiment of the invention said outlet aperture (5) is arranged downstream of said inlet aperture (6) and one or more of said apertures (5, 6) are fluid communication apertures for said flow (F) between said shunt flow passages (4) and said annulus space (20).

In an embodiment of the invention one has a combinations of the two above described embodiments.

Advantages and principles of these embodiments are further described below.

Aperture to Annulus and Base Pipe

According to an embodiment of the invention illustrated in FIG. 4, the inlet aperture (6) is hydraulically connected to said annulus (20), said outlet aperture (5) connected to said base pipe (10), so as for measuring pressure drop from said annulus to said base pipe. In the illustrated case wherein there is a base pipe screen or perforation upstream or downstream it will still measure the pressure difference in the main flow and the annulus flow from inlet aperture (6) to outlet aperture (5). If arranged on a blank pipe it will measure the pressure difference across the base pipe wall.

Annulus Flow

In an embodiment illustrated in FIG. 5, both said inlet aperture (6) and said outlet aperture (5) are hydraulically connected to said annulus (20), so as for measuring the pressure gradient in the annulus (20). This is illustrated with a blank pipe, but an embodiment with a screen or apertures in the base pipe is envisaged.

Across Packer Measurement

In the embodiment illustrated in FIG. 6, the tracer release flow shunt chamber of the invention comprises a zonal isolating packer (11) isolating about said tracer release flow shunt chamber (1) and said base pipe (10) between said inlet apertures (6) and said outlet aperture (5) and so that annulus flow is blocked, the main flow in the base pipe is allowed and a shunt flow, which will be much less than the main flow, is also allowed. (FIG. 6), so as for measuring pressure across said packer.

Completion

The invention is also a petroleum well completion comprising a base pipe (10) with an annulus space (20) in a petroleum well please see FIG. 9, comprising one or more tracer release flow shunt chambers (1) as described above, arranged along said base pipe (10). They may be arranged according to the desire of the well operator with apertures to the base pipe only, to the annulus only, or across packers, all as described above, and in different embodiments along the well.

Several Chambers in One Location

In an embodiment of the invention, two or more flow shunt chambers (1) with the same unique tracer molecule (3) type are arranged about a circumference of said base pipe (1) at a location along said base pipe (1), in order to strengthen the concentration of the released tracer, particularly in case of high fluid flow past said flow shunt chambers (1) locally, for obtaining a significantly detectable tracer concentration topsides arising from that location.

In an embodiment of the invention, the base pipe (10) comprises one or more screen portions (17) or perforations upstream or downstream of one or more of said tracer release chambers (1). This may balance the flow between the base pipe (10) and the annulus (20), but anyway also balance out any longitudinal pressure differences, and thus release according to pressure difference.

Method

The invention is a method of estimating one or more pressure differences or gradients along a producing petroleum well with a completion with a base pipe (10) in an annulus (20) and with one or more flow shunt chambers (1) according to the above description, having unique tracer molecules or particles (3) for each depth along the base pipe (10) and arranged along part or all of said base pipe (10), particularly at least through the relevant influx zones of the well, allowing well fluids to flow at a stable production flow rate, and injecting a shot of tracer molecules or particles in the flow shunt chamber, all while collecting a time-stamped series of fluid samples from said well fluids at a topsides sampling location, analyzing said series of fluid samples for concentrations of said tracer molecules or particles (3), calculating topsides tracer flux rate versus time curves from said concentrations and said flow rates for each tracer molecule (3) type, identifying tracer flux transients associated with the shot injection, based on said tracer flux rate curves, calculating time constants for each tracer flux transient for each tracer molecule or particle (3) type for said flow shunt chambers (1), based on said time constants, estimating a pressure difference between said inlet aperture (6) and said outlet aperture (1) of each flow shunt chamber (1).

Relative Pressure Differences

In an embodiment of the invention one estimates the relative pressure differences of two or more flow shunt chambers (1) based on ratios between their corresponding calculated time constants. In order to achieve this one needs to know the relative release properties of the compared flow shunt chambers as a function of pressure difference, of which chambers the flow has passed.

Absolute Pressure Differences

In an embodiment of the invention, one may estimate absolute pressure differences over one or more flow shunt chamber (1) based on a calibration of said flow shunt chamber's (1) time constant for one or more known pressure differences between said inlet aperture (6) and said outlet aperture (5). Each said flow shunt chamber (1) is arranged with a first, inlet aperture (6) for outside fluid (F6) to enter a flow shunt passage (4) with a unique tracer carrying system (2) (for that particular depth) exposed to and arranged for releasing tracer molecules or particles (3) according to some control to a shunt chamber fluid (F3), and with a second, outlet aperture (5) from said shunt flow passage (4) arranged downstream of said first inlet aperture (6), for releasing said shunt chamber fluid (F3) to a fluid (F5) outside said second outlet aperture (5). In practice, arranging said flow shunt chamber (1) extending generally axial-parallel with said basepipe (10). The flow shunt chamber (1) is provided with a flow restrictor nozzle unit (70) between said tracer carrying system (2) and said second outlet aperture (6), allowing a pressure gradient between said inlet and outlet apertures (6, 5) to drive said shunt chamber fluid (F3) through said flow restrictor nozzle unit (70).

The flow shunt chamber may in an embodiment of the invention advantageously be calibrated before installation of the completion in the well, but may also be calibrated by measuring in-site pressure differences with other pressure meters arranged in parallel with the flow shunt chamber installed. The calibration of said flow shunt chamber (1) may be conducted by measuring the time constant for a given, known flow shunt chamber geometry with a known flow restrictor nozzle unit (70) under a known pressure difference in the laboratory (or in the well). During such calibration one should use petroleum fluids of known viscosity and composition and temperature. The flow restrictor nozzle unit (70) in the shunt flow passage (4) is literally the bottleneck of the flow shunt chamber (1), please see FIG. 1*c*, together with the shunt chamber geometry it controls the time constant. The time constant may thus be changed by replacing the flow restrictor nozzle unit (70) with another flow restrictor nozzle unit (70) with different aperture, or adjusting the aperture of the flow restrictor nozzle unit. Alternatively, adjusting the flow restrictor nozzle unit (70) may be done e.g. by adjusting the cross-section of the flow restrictor aperture (72) by means of a flow adjustment screw (71) in the flow restrictor plug aperture (72) in the flow restrictor nozzle unit (70).

In practice, we are arranging said flow shunt chamber (1) extending generally axial-parallel with said basepipe (10).

Optionally, if it is allowed to partly block the passage in the base pipe (10), we may arrange the flow shunt chamber (1) on the inner wall of the base pipe (10) or in a side pocket mandrel (10S).

In an embodiment of the method of the invention, it is used a tracer carrying system (2) arranged for releasing said tracer molecules or particles (3) at a steady time release rate into the surrounding shunt chamber fluid (F3).

Basic Assumptions

Proportional Flow and Pressure Difference:

If the flow restrictor nozzle unit (70) is obeying Darcy's law (narrow tubes, porous media) the relationship between flow and pressure difference becomes (linearly) proportional, and thus it is possible to calibrate the flow shunt chamber (1).

Proportional Fluid Flows in Base Pipe (10) and Shunt Flow Chamber (1):

One may assume in a simplified model of the fluid flows through the flow shunt chamber (1) and the base pipe (10) that fluid flow ($\Phi_{chamber}$) through the shunt flow passage (4) is proportional or linearly related to the fluid flow ($\Phi_{basepipe}$) through the base pipe (10), given that the pressure difference ($P_6$-$P_5$) over the same distance along them are the same. The fluid flow rates ($\Phi_{chamber}$), ($\Phi_{basepipe}$), ($\Phi_{annulus}$) are denoted in volume per time unit; litres/s.

Calibration of Shunt Flow Chamber (1):

Depending particularly on the flow restrictor nozzle unit (70), the proportional or otherwise linearly related ratio of fluid flow per time unit distributed between the flow passage (4) and the base pipe (10), ($\Phi_{chamber}$)/($\Phi_{basepipe}$) may be determined or calibrated before installation of the basepipe and completion section component with the shunt flow chamber (1).

Similarly, the ratio of fluid flow per time unit distributed between the flow passage (4) and the annulus (20) ($\Phi_{chamber}$)/($\Phi_{annulus}$), or between the flow passage (4) and the combined flow through base pipe (10) and the annulus (20), may be calibrated in the laboratory before installation of the completion. The desired calibration depends on which flows the first and second apertures (6, 5) are adjacent to.

Tracer Flux From the Flow Shunt Chamber (1)

The flow of molecules or particles from said shunt chamber fluid (F3) is released to the basepipe flow (F5) further out of outlet aperture (5) where it mixes into the outside flow (F5) and is eventually picked up topsides where samples may be taken from the basepipe flow for being analyzed for concentration. What is here called the "outside flow" (F5) depends on whether the second, downstream aperture (5) is to the base pipe directly, to the annulus flow directly, or to a screen between the two.

Topsides Sampling and Analysis.

A continuous measurement of production flows of oil, water and gas topsides must of course be recorded. Samples are taken at desired points in time depending on the progress of the method according to the invention. The samples are analyzed for the presence of each of the installed tracer carriers' (2) molecule ($3_1$, $3_2$, . . . , $3_n$) types installed in the flow shunt chambers (1) along the base pipe. The samples are collected as a function of time, as mentioned above. The topsides concentrations ($c1_{sample}(t_i)$), ($c2_{sample}(t_i)$), . . . ($cn_{sample}(t_i)$) are registered as function of ($t_i$) for i=1 to m. Further, each concentration ($c1_{sample}(t_i)$) must, for the method to work, be corrected for the instantaneous topsides production flow ($\Phi_{topside}$) when the sample is taken, in order to calculate the topside tracer flux ($\rho_{topside}$) for each tracer molecule (3) type: ($\rho 1_{topside}$), ($\rho 2_{topside}$), . . . , ($\rho n_{topside}$) for ($t_i$) for i=1 to m. Then one arrives at curves which should resemble FIG. 8.

FIG. 8 shows graphs of measurements of tracer flux measurements versus time, for an injected shot.

Obtaining a Robust Tracer Flux Signal

For the situations illustrated and described in connection with FIGS. 7 and 8. For obtaining a good tracer flux curve with robustness for travelling undisturbed to surface it is an advantage to calibrate the flow shunt chamber with the flow restrictor nozzle unit (70) so as for obtaining a time constant $t_{1/2}$ longer than typical period times for any hydraulic instability and for travelling undisturbed of other dispersion effects.

The first inlet aperture (6) is at a relatively higher pressure than the downstream second outlet aperture (5). This may be due to said first inlet aperture (6) being in fluid communication with an upstream part of said base pipe (10) or said annulus (20) or both, and said outlet aperture (5) being in fluid communication with a downstream part of said base pipe (10) or said annulus (20) or both. The pressure decreases in a downstream direction generally; this is why fluids flow through the base pipe (10) or annulus (20), and in particular through the passage (4) of the device of the present invention. The pressure difference (or gradient) drives a flow through the passage (4) from the inlet aperture (6) through the outlet aperture (5). Which parameters that control, restrict or brake the flow of the shunt chamber fluid (F3) through the passage (4) are:

inertia (negligible),
fluid friction (parallel flow or turbulent flow),
the fluid restrictor (7),
viscosity,
temperature, and
possible clogging at the inlet aperture (6).

In general, without the fluid restrictor (7), the flushout time from the passage (4) through flow shunt chamber (1) would be rather short, and the flow through would be large, and the release time for the shunt chamber fluid rather short compared to the flushout time downstream through the production tubing and the tie-back to the petroleum platform. Thus it could be difficult to obtain a well detectable tracer flux pulse peak. The fluid restrictor (7) (which may be integrated with the outlet aperture (5) or arranged in the passage (4) between the tracer carrying system (2) and the outlet aperture (5), may be designed as the "bottleneck" controlling component of the passage (4) as illustrated in FIGS. 1, 2 and 3, and be made adjustable or exchangeable to a desired flow-through property.

The invention claimed is:

1. A petroleum well tracer release system comprising one or more petroleum well tracer release flow shunt chamber(s) for being arranged in an annulus space about a base pipe in a petroleum well said one or more flow shunt chamber(s) extending generally axial-parallel with said basepipe, said one or more flow shunt chamber(s) provided with shunt flow passage(s) for holding shunt chamber fluid (s), said flow shunt chamber(s) further comprising:

one or more tracer carrier systems in said shunt flow passages, wherein said one or more tracer carrier systems comprises means for intermittently introducing a predefined amount of unique tracer molecules or particles into said flow shunt chamber(s) according to a control from surface and/or by a downhole state, one or more first inlet apertures to said flow shunt passages for receiving one or more first fluid from outside said inlet apertures, one or more outlet apertures, from said shunt flow passages arranged downstream of said first inlet apertures, said outlet apertures for releasing said shunt chamber fluid to a fluid outside said outlet apertures, one or more flow restrictor nozzle units arranged in said flow shunt passage between said one or more outlet aperture and said inlet aperture, and downstream said tracer carrier system, allowing a pressure gradient between said one or more inlets and outlets apertures driving said shunt chamber fluid out via said flow restrictor nozzle units.

2. The petroleum well tracer release system of claim 1, said tracer carrier system injection being controlled by a downhole timer device.

3. The petroleum well tracer release system of claim 1, said tracer carrier system injection being controlled by command from surface, the command being transmitted either wirelessly or by wire.

4. The tracer system of claim 1, said tracer carrier system injection being controlled by downhole states such as pressure, temperature, flow velocity, conductivity, salinity, viscosity, etc.

5. The petroleum well tracer release system of claim 1, wherein a flushout time constant of the system is adjustable by replacing the one or more flow restrictor nozzle units of a first aperture with another one or more flow restrictor nozzle units with different aperture, or adjusting the aperture of the flow restrictor nozzle unit.

6. The tracer system of claim 1, wherein a flushout time constant of the system is adjustable by adjusting the flow restrictor nozzle unit by adjusting the cross-section of the flow restrictor aperture by means of a flow adjustment screw in the flow restrictor plug aperture in the flow restrictor nozzle unit.

7. The petroleum well tracer release system of claim 1, said one or more flow shunt chambers provided with a first particle filter in said flow shunt passage between inlet apertures and said flow restrictor nozzle unit.

8. The petroleum well tracer release system of claim 7, said inlet aperture(s) provided with said first particle filter.

9. The petroleum well tracer release system of claim 1, said flow shunt chambers provided with a second particle filter between said flow restrictor nozzle unit in said flow shunt passage and said second, outlet aperture.

10. The petroleum well tracer release system of claim 9, said second outlet apertures provided with said second particle filter.

11. The petroleum well tracer release system of claim 1, said first inlet apertures directly fluid communicating via said shunt flow passages and said flow restrictor nozzle unit to said second outlet apertures.

12. The petroleum well tracer release system of claim 1, said flow shunt chambers provided with check valve(s) to allow fluids to flow through the shunt chambers in one direction only.

13. The petroleum well tracer release system of claim 1, said flow shunt chambers placed in said annulus formed outside of said base pipe in said petroleum well.

14. The petroleum well tracer release system of claim 13, said apertures and being hydraulically connected to the fluids in said base pipe so that the shunt flow Q, is a function of the pressure distribution along the base pipe's interior, the base pipe being either a blank pipe section or a perforated section or a combination of the two.

15. The petroleum well tracer release system of claim 14, a number of the shunt chambers mounted in a barrel array around the circumference of the base pipe, said inlet apertures mutually connected by a first venting end ring open inwardly to said base pipe, said outlet apertures are also mutually connected by a second venting end ring open inwardly to said base pipe, said shunt chambers are isolated from each other between said end rings by partition walls.

16. The petroleum well tracer release system claim 15, said barrel array around the circumference of the base pipe sealingly cemented by cement to the borehole wall.

17. The petroleum well tracer release system of claim 13, said inlet aperture being hydraulically connected to said annulus, said outlet aperture connected to said base pipe, so as for measuring pressure drop from said annulus to said base pipe.

18. The petroleum well tracer release system of claim 13, both said inlet aperture and said outlet aperture being hydraulically connected to said annulus, so as for measuring the pressure gradient in the annulus.

19. The petroleum well tracer release system of claim 13, comprising a zonal isolating packer isolating about said tracer release flow shunt chamber and said base pipe between said inlet apertures and said outlet aperture and so that annulus flow is blocked, but a shunt flow is allowed, so as for measuring pressure across said packer.

20. A petroleum well completion comprising a base pipe with an annulus space in a petroleum well, comprising one or more tracer release flow shunt chambers, according to claim 1, arranged along said base pipe.

21. The petroleum well completion of claim 20, comprising:

one or more tracer release chambers, wherein said flow shunt chambers are provided with a second particle filter between said flow restrictor nozzle unit in said flow shunt passage and said second, outlet aperture.

22. The petroleum well completion of claim 20, comprising:

one or more tracer release chambers, wherein said second outlet apertures are provided with said second particle filter.

23. The petroleum well completion of claim 20, comprising:

one or more tracer release chambers, wherein said first inlet apertures are directly fluid communicating via said shunt flow passages and said flow restrictor nozzle unit to said second outlet apertures.

24. The petroleum well completion of claim 20, comprising:

one or more tracer release chambers, wherein said inlet aperture are hydraulically connected to said annulus, and wherein said outlet aperture is connected to said base pipe, so as for measuring pressure drop from said annulus to said base pipe.

25. The petroleum well completion of claim 20, comprising two or more flow shunt chambers with the same unique tracer molecules or particles type arranged about a circumference of said base pipe at a location along said base pipe, in order to strengthen the concentration of the released tracer in case of high fluid flow past said flow shunt chambers locally, for obtaining a significantly detectable tracer concentration topsides arising from that location.

26. The petroleum well completion of claim 20, said base pipe comprising one or more screen portions or perforations upstream or downstream of one or more of said tracer release chambers.

27. A method of estimating one or more pressure differences or gradients along a producing petroleum well with a completion with a base pipe in the annulus and with one or more flow shunt chambers according to claim 1 with unique tracer molecules or particles and arranged along part or all of said base pipe, allowing well fluids to flow at a stable production flow rate, intermittently introducing a predefined amount of unique tracer molecules or particles into said flow shunt chamber(s) according to a control from surface and/or by a downhole state so that tracer clouds are formed in the shunt chamber fluid, allowing a pressure gradient between one or more inlets and outlets apertures of said shunt chamber driving said shunt chamber fluid out via the flow restrictor nozzle units, while collecting a time-stamped series of fluid samples from said well fluids at a topsides sampling location, analyzing said series of fluid samples for concentrations $(c1_{sample}(t_i))$, $(c2_{sampie}(t_i))$, . . . $(cn_{sample}(t_i))$, calculating topsides tracer flux rate $(\rho_{topside})$ versus time or produced volume curves from said concentrations $(ci_{sample}(t_i)$ and said flow rates $(\Phi_{topside})$ for each tracer molecule or particle type, identifying tracer flux transients associated with a flush-out of the tracer cloud(s) from a downhole shunt chamber(s), based on said tracer flux rate curves, calculating time constants $(t_{i1/2})$ for each tracer flux transient for each tracer molecule or particle type for said flow shunt chambers, based on said time constants $(t_{i1/2})$, estimating a pressure difference between said inlet aperture and said outlet aperture of each flow shunt chamber, based on the pressure differences, estimate an inflow profile.

28. The method of claim 27, estimating relative pressure differences of two or more flow shunt chambers based on ratios between their corresponding calculated time constants $(t_{i1/2})$.

29. The method of claim 27, estimating absolute pressure differences over one or more flow shunt chamber based on a calibration of said flow shunt chamber's time constant ($t_{i1/2}$) for one or more known pressure differences between said inlet aperture and said outlet aperture.

30. The method of claim 27, using or calibrating one or more of said flow restrictor nozzle units to provide time constants ($t_{i1/2}$) long enough for tracer flux signal pulses to travel from a production zone to a surface.

* * * * *